United States Patent [19]

McFarland

[11] 4,177,651

[45] Dec. 11, 1979

[54] APPARATUS AND METHOD OF HEATING AND COOLING

[76] Inventor: Lorrell C. McFarland, 417 E. 12, Claremore, Okla. 74017

[21] Appl. No.: 865,266

[22] Filed: Dec. 28, 1977

[51] Int. Cl.[2] ..... F25B 27/00

[52] U.S. Cl. ..... 62/238; 62/467 R; 60/671

[58] Field of Search ..... 62/467, 238 C, 324 A; 60/651, 671, 648, 655, 650, 682

[56] References Cited

U.S. PATENT DOCUMENTS

| | | | |
|---|---|---|---|
| 1,979,128 | 10/1934 | Watson | 62/238 C |
| 2,952,138 | 9/1960 | Russell et al. | 60/671 |
| 3,234,738 | 2/1966 | Cook | 60/650 X |
| 4,093,868 | 6/1978 | Manning | 60/648 X |

FOREIGN PATENT DOCUMENTS

| | | | |
|---|---|---|---|
| 104175 | 10/1921 | Switzerland | 60/655 |

*Primary Examiner*—Allen M. Ostrager
*Attorney, Agent, or Firm*—Robert K. Rhea

[57] ABSTRACT

A Freon driven engine, drivably connected with the compressor of an air conditioner unit, utilizes normally wasted heat from the air conditioner condenser to supplement the heat supplied by a primary heat source thus reducing the quantity of energy normally required from the heat source to expand Freon and maintain operation of the engine. The evaporator of the air conditioner unit is utilized to reduce the temperature of the Freon exhausted by the engine before return to the heat source.

4 Claims, 2 Drawing Figures

APPARATUS AND METHOD OF HEATING AND COOLING

BACKGROUND OF THE INVENTION

1. Field of the Invention

The present invention relates to space heating and cooling and more particularly to an apparatus and method of utilizing normally wasted heat from the condenser of an air conditioner unit for conserving normally wasted heat energy.

In the operation of an air conditioner unit, the heat from its condenser is normally exhausted by a fan to the atmosphere thus representing a considerable loss of energy.

This invention contemplates driving the compressor of an air conditioner unit by a Freon driven engine, such as is disclosed by my U.S. Pat. No. 3,983,704 wherein the Freon must be heated to drive the engine. The normally wasted heat from the air conditioner condenser being utilized as a heat source supplementing a primary heat source expanding the Freon to drive the engine thereby conserving energy.

2. Description of the Prior Art

I do not know of any patents disclosing this invention.

SUMMARY OF THE INVENTION

An engine driven by a heat expanded nonflammable gaseous and liquid hydrocarbon, such as Freon, is drivably connected to the compressor of an air conditioning unit. The heat generated by the air conditioner condenser forms a supplementary heat source which is applied to the Freon to be expanded for driving an engine. The expanded Freon exhausted by the engine is cooled by a heat exchanger connected with the evaporator of the air conditioner unit with the cooled Freon recycled to the engine. Excess heating and cooling from the air conditioner condenser and evaporator is respectively utilized for heating and cooling space.

The principal object of this invention is to utilize normally wasted heat radiated by the condenser of a conventional air conditioner unit as a heat source for expanding Freon driving an engine drivably connected with the air conditioning unit compressor.

DESCRIPTION OF THE PREFERRED EMBODIMENTS

Figure 1:
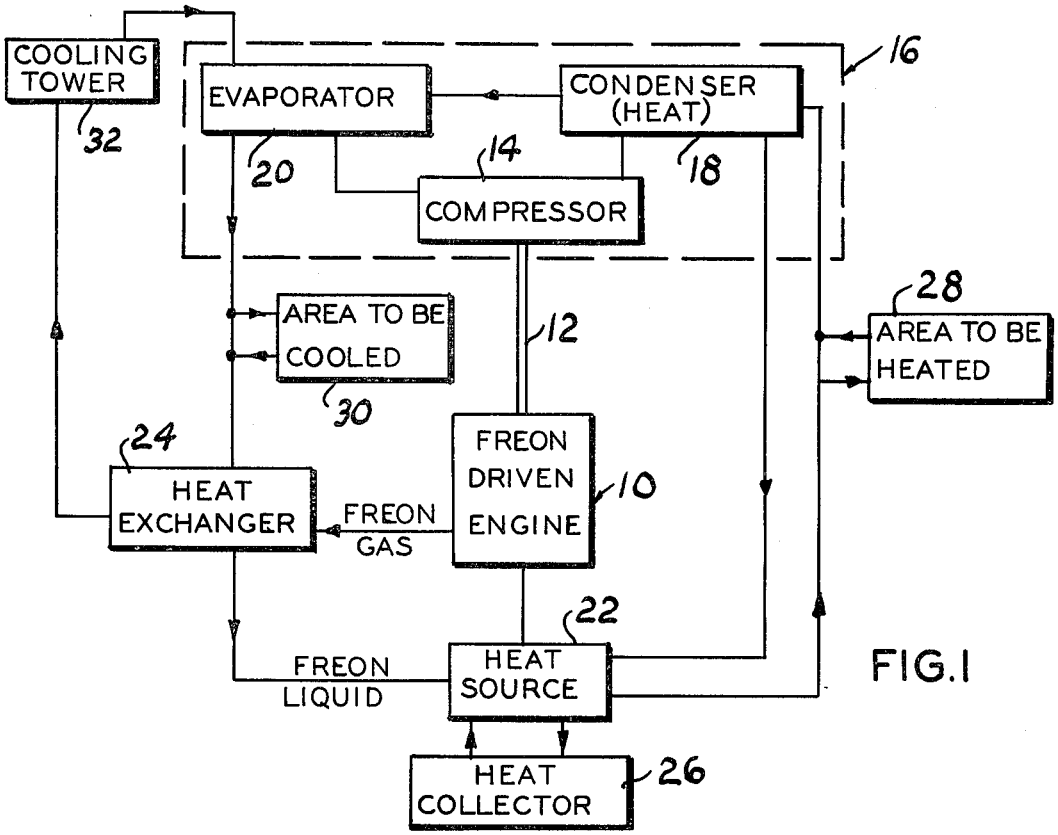
FIG. 1 is a flow diagram.

Like characters of reference designate like parts in those figures of the drawings in which they occur.

In the drawings:

Referring to FIG. 1, the reference numeral 10 indicates an engine driven by a nonflammable gaseous and liquid hydrocarbon, such as Freon, of the type dislcosed by my U.S. Pat. No. 3,983,704. The engine 10 is drivably connected by its drive shaft 12 with the compressor 14 of an air conditioner unit 16. The air conditioner unit 16 is conventional and includes a condenser 18 and an evaporator 20. The Freon driving the engine 10 is expanded by heat from a heat source 22 to drive the engine 10. The heat source 22 may be solar energy, as disclosed by my above named patent, or a fuel burning burner, not shown. Freon gas exhausted by the engine 10 is condensed to a liquid by passing through a heat exchanger 24 circulating a coolant cooled by the evaporator 20, the Freon liquid being returned to the heat source 22 for expansion and returning to the engine in a continuous cycle. Excess heat radiated by the condenser 18 is conveyed to the heat source 22 to be utilized for expanding the Freon. Any excess heat above that necessary for expanding the Freon is stored in a liquid or other suitable medium contained by a heat collector 26 connected with the heat source. Conductors, such as tubing and control valves, not shown, are utilized for the flow path of the Freon and connecting the condenser 18 with the heat source 22 and connecting the evaporator 20 with the heat exchanger 24.

An area to be heated 28 is connected with the heat conductors between the condenser 18 and heat source 22 and similarly an area to be cooled 30 is connected with the coolant conductor between the evaporator 20 and heat exchanger 24. A cooling tower 32 may be interposed between the heat exchanger 24 and the evaporator 20.

Figure 2:
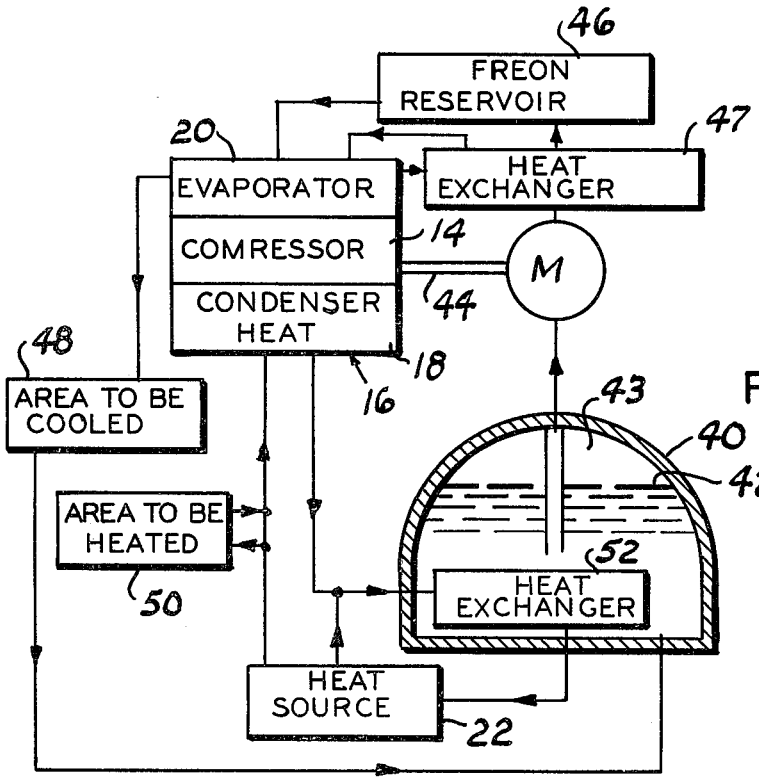
FIG. 2 is a diagrammatic view.

Referring more particularly to FIG. 2, an alternative embodiment of the Freon engine is illustrated wherein a Freon evaporator 40 contains a quantity of Freon liquid 42. The evaporator 40 is connected with a fluid driven motor M having its drive shaft 44 connected with the compressor 14 of the air conditioning unit 16. Vaporized Freon gas 43, collecting in the top of the evaporator 40, forces the liquid Freon 42 to the motor M. Liquid Freon or gas exhausted by the motor M is received by a Freon reservoir 46 interposed between the motor M and evaporator 20. A heat exchanger 47, containing a coolant cooled by the evaporator 20, partially cools or condenses the engine exhausted Freon before it enters the reservoir. The evaporator 20 completes the cooling of the Freon. The cooled Freon is returned to the Freon evaporator 40 from the evaporator 20 through an area to be cooled 48.

The heat source 22 circulates heat through a heat exchanger 52 disposed within the Freon liquid 42 within the evaporator 40 for expanding the latter and driving the motor M. The heat source 22 and heat exchanger 52 are also connected with the condenser 18 for supplementing the energy normally required by the heat source 22. Similarly, an area to be heated 50 is connected with the heat conductor between the heat source 22 and condenser 18.

Obviously the invention is suceptible to changes or alterations without defeating its practicability. Therefore, I do not wish to be confined to the preferred embodiment shown in the drawings and described herein.

I claim:

1. The method of utilizing the normally wasted heat of an air conditioning system, comprising: providing an air conditioner unit having a compressor, a condenser and an evaporator; drivably connecting a liquid hydrocarbon operated engine with said compressor; connecting a primary heat source with said engine; conveying the heat exhausted by said condenser to the primary heat source; connecting said evaporator with a heat exchanger; interposing an area to be cooled between the evaporator and the heat exchanger; passing the heated liquid hydrocarbon exhausted by said engine through said heat exchanger; and, returning the cooled liquid hydrocarbon to said engine.

2. The method according to claim 1 including the additional step of interposing a cooling tower between the heat exchanger and the evaporator.

3. The method according to claim 1 including the additional step of interposing an area to be heated between the primary heat source and the condenser.

4. The method according to claim 3 including storing excess heat generated by the primary heat source and the condenser.

* * * * *